United States Patent [19]

Gallaro

[11] Patent Number: 4,516,768

[45] Date of Patent: May 14, 1985

[54] EXERCISE DEVICE

[76] Inventor: Carmelo Gallaro, 490 Henry St., Brooklyn, N.Y. 11231

[21] Appl. No.: 424,079

[22] Filed: Sep. 27, 1982

[51] Int. Cl.[3] ..... A63B 5/00; A63B 23/02

[52] U.S. Cl. ..... 272/65; 272/70; 272/144; 272/145; 272/DIG. 9

[58] Field of Search ..... 272/70, DIG. 9, 130, 272/65, 66, 134, 135, 136, 137, 138, 141, 144, 1 B, ; 441/53, 54, 131, 136

[56] References Cited

U.S. PATENT DOCUMENTS

| | | | |
|---|---|---|---|
| 945,575 | 1/1910 | McPherson | 52/667 X |
| 3,130,816 | 4/1964 | Wright | 272/65 |
| 4,037,834 | 7/1977 | Oaks | 272/70 X |
| 4,159,826 | 7/1979 | Hancock | 272/65 |
| 4,323,231 | 4/1982 | Wilson | 272/65 |

FOREIGN PATENT DOCUMENTS

| | | | |
|---|---|---|---|
| 2333672 | 1/1975 | Fed. Rep. of Germany | 272/65 |
| 26464 | of 1898 | United Kingdom | 52/667 |
| 1604537 | 12/1981 | United Kingdom | 272/70 |

*Primary Examiner*—Robert A. Hafer
*Assistant Examiner*—Arnold W. Kramer
*Attorney, Agent, or Firm*—Goodman & Teitelbaum

[57] ABSTRACT

An exercising device including an inflatable flexible toroidal member such as a tire tube, a substantially rigid platform disposed over and supported by the toroidal member, and foot treads positioned on the platform. The exercising device can be used not only for jogging, running, or jumping in place, but with the addition of an exercising board and an exercising stand, can also be used for sit-ups and the like.

21 Claims, 8 Drawing Figures

EXERCISE DEVICE

BACKGROUND OF THE INVENTION

This invention relates to an exercise device, and more particularly to a resilient exercise device permitting in place exercising.

With a continuous increased awareness of the importance of exercising, numerous exercising devices are readily available to provide assistance in carrying out various exercises. One of the most popular types of exercices is that of jogging. However, normally, jogging requires a large area or track, and in most cases this exercise must be done on the outside. As a result, many people are prevented from jogging because of the lack of suitable outdoor facilities. In order to alleviate this situation, many types of indoor jogging apparatus are available to permit jogging in place so as to permit indoor jogging. For example, mechanized treadmills and the like are readily available.

Most of the apparatus utilized for jogging are quite costly, cumbersome, and are not very convenient. For example, some of these devices have a flat surface on which the individual runs or jumps. The running or jumping is usually quite noisy thereby causing a disturbance to those around the jogger. Also, because of the flat surface, there is a hard impact on the bottom of the feet of the jogger. Additionally, when jogging outside on a terrain other than a flat hard surface, the ground is uneven. This uneven ground actually benefits the jogger since it requires greater exertion due to the shifting of the center of gravity of the body and the constant muscular action necessary to maintain body balance. However, most indoor jogging apparatus are of the flat surface type and thereby avoid the benefits available from jogging on an uneven ground surface.

Accordingly, it would be convenient to have an exercising device which can be utilized for indoor jogging, walking, or jumping in place, and which would avoid or reduce the pounding impact noise to thereby eliminate the disturbance to others. At the same time, the device should be resilient to avoid the hard impact of the jumping exercising to thereby soften the blow to the feet of the jogger. Also, it would be convenient to provide a flexible surface which simulates the uneven terrain of an outside jogging track to thereby provide increased use of the jogger's muscles.

Additionally, many types of exercising devices are dedicated to one particular type of exercise. When one wants to vary the types of exercises, he must use many separate and independent pieces of equipment. This results in a costly situation as well as a space problem since each of these devices must occupy a separate part of a gym or other exercise room.

It would therefore also be convenient to have an exercise device which in addition to providing the benefits of indoor jogging and the like, can also be utilized to accommodate other pieces of exercising equiment to thereby effectively produce an exercising device having broader capabilities than a simple jogging apparatus.

SUMMARY OF THE INVENTION

Accordingly, it is an object of the present invention to provide an exercising device which avoids the aforementioned problems of prior art devices.

Another object of the present invention is to provide an exercising device which can be utilized for jogging, running, or jumping in place, and which provides a flexible surface to thereby eliminate the hard impact on the feet of a jogger.

Still a further object of the present invention is to provide an exercising device which permits jogging, running or jumping in place, and avoids the disturbing pounding noise normally associated with such activities.

Another object of the present invention is to provide an exercising device which permits jogging, running, or jumping in place, and simulates a rough terrain to thereby require greater exertion and greater use of the user's muscles in order to maintain the center of gravity of the user's body in an upright balanced position.

Yet a further object of the present invention is to provide an exercising device which can be used for jogging in place, and can also be used to accommodate other pieces of exercising equipment, such as an exercising board and an exercising stand.

A further object of the present invention is to provide an exercising stand which can be utilized for various exercises, and which can accommodate other pieces of exercising equipment, such as an exercising board and an exercising resilient platform.

Briefly, in accordance with the present invention, there is provided an exercising device having an inflatable flexible toroidal member such as a tire tube. A substantially rigid platform is disposed over and supported by the toroidal member. Foot treads are positioned on the platform.

In one embodiment of the present invention, the platform itself can have a degree of flexibility by forming it of a plurality of elongated rigid slats which are separated from each other by resilient spacers.

The toroidal member can be wrapped, by means of an adhesive wrap, to maintain it in its toroidal configuration thereby avoiding bulges. Furthermore, in order to accommodate an oval shaped platform, a band can be placed around the midsection of the toroidal member to reshape it into an oval configuration corresponding to the platform.

The present invention further contemplates the use of an exercising board which can be balanced across the toroidal member. One end of the exercising board can be elevated by inserting it into an exercising stand. The exercising stand includes a base with a pair of upstanding sidewalls and a top wall. A shelf is positioned between the upstanding walls and spaced below the top wall. The top wall is rearwardly displaced from the shelf to permit easy access to the shelf. A pair of facing channels are formed into the sidewalls to form a slot which receives and holds the exercising board in the elevated position.

BRIEF DESCRIPTION OF THE DRAWINGS

With the above and additional objects and advantages in view, as will hereinafter appear, this invention comprises the devices, combinations and arrangements of parts hereinafter described, by way of example and illustrated in the accompanying drawings of a preferred embodiment in which.

In the various Figures of the drawings, like reference characters designate like parts.

DESCRIPTION OF THE PREFERRED EMBODIMENT

Figure 1:
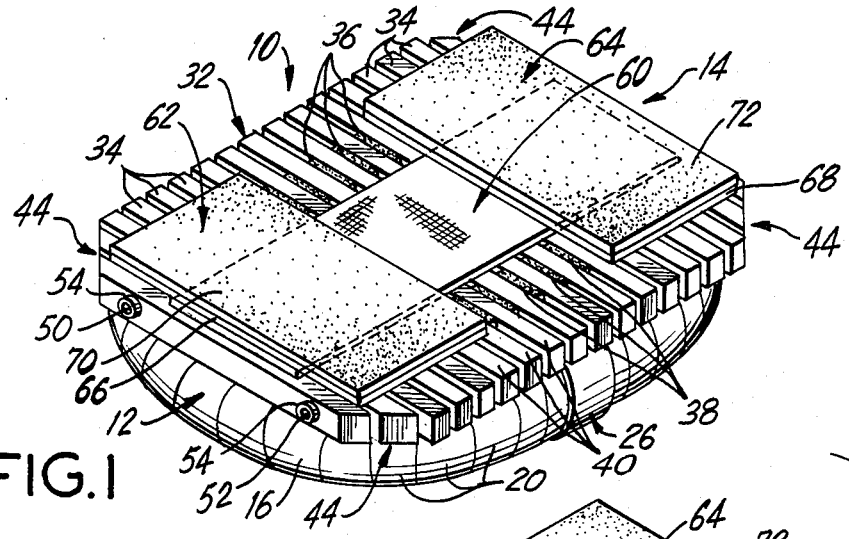
FIG. 1 is a perspective view of an exercising device using a toroidal member according to the present invention.
Figure 2:
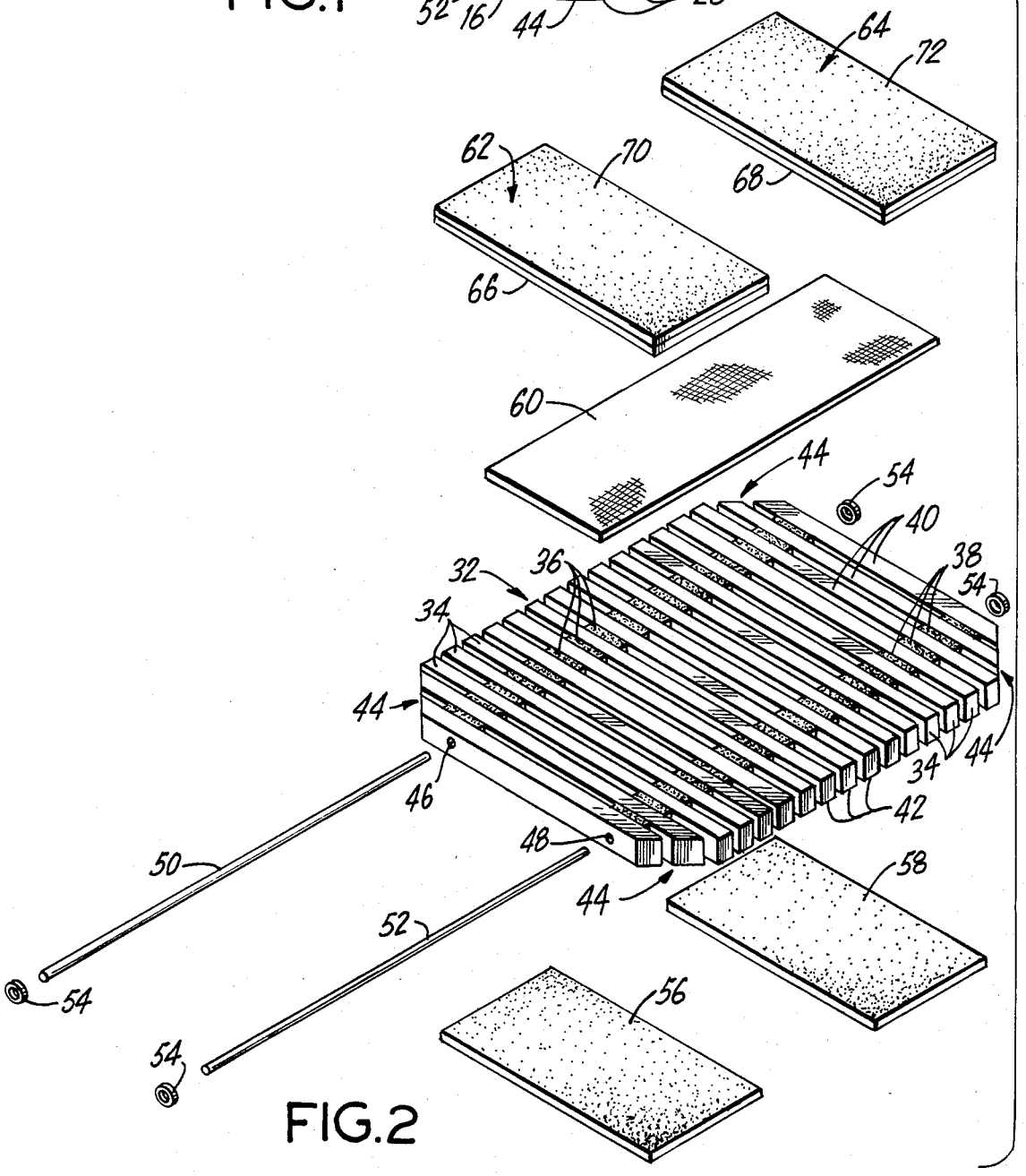
FIG. 2 is an exploded perspective view showing the parts of the platform assembly which fits onto the flexible toroidal member.
Figure 3:
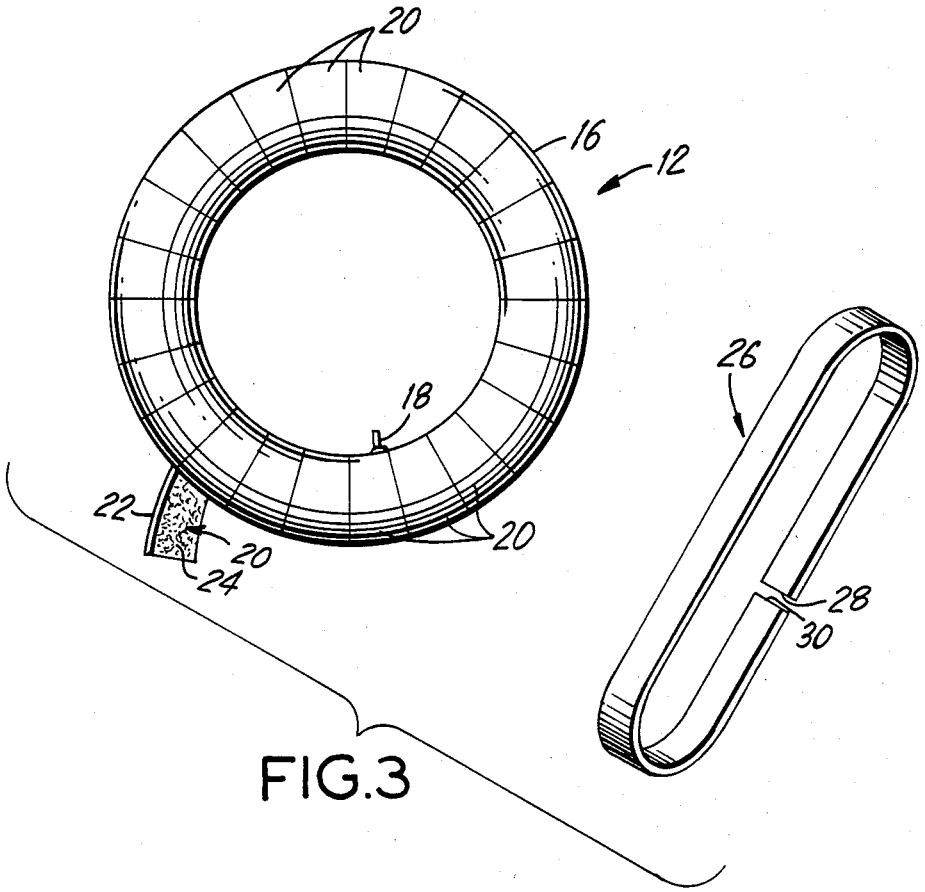
FIG. 3 is an exploded perspective view showing the assembly forming the flexible toroidal member.

Referring now to FIGS. 1–4, there is generally shown an exercising device at 10 having a lower resilient assembly 12 and an upper platform assembly 14. The lower assembly 12 includes an inflatable toroidal member 16, such as a tire tube, which can be inflated by means of a standard valve assembly 18. In order to maintain the toroidal member 16 in an annular configuration and avoid bulges thereon, the toroidal member 16 can be transversely wrapped with a strip 20 with adjacent transverse sections of the strip overlapping to thereby completely cover the entire surface of the toroidal member, as best shown in FIG. 3. The particular strip 20 can be any type of wrapping material, such as an elastic band 22, and can include an adhesive surface 24 on one side to provide self sticking inner surface for the wrapping strip.

Figure 4:
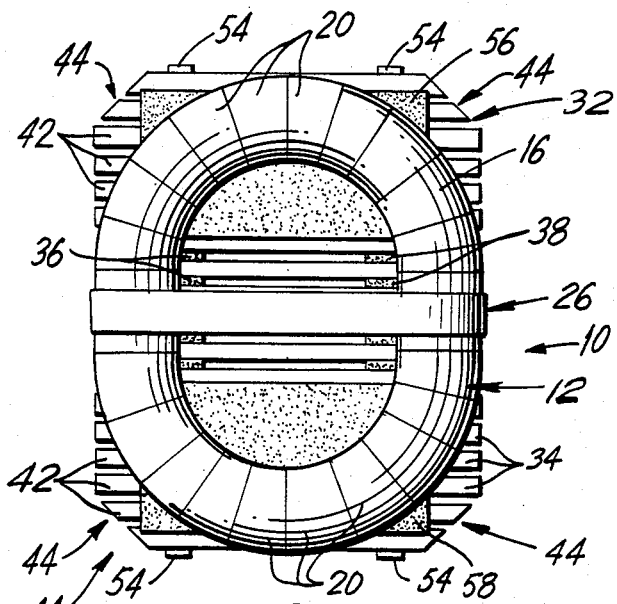
FIG. 4 is a bottom plan view of the underside of the exercising device shown in FIG. 1.

A heavy duty resilient band 26 can be placed about the mid section of the toroidal member 16 to diametrically squeeze the mid section thereby reshaping the toroidal member into an oval configuration, as best shown in FIG. 4. The band 26 can be either a continuous endless band or it can be made into a loop when the ends 28, 30 are fastened together in a conventional manner. The material of the band 26 can be of any heavy duty rubber or plastic material. Furthermore, the shape of the toroidal member 16 can be structured into various configurations using such a band 26.

The platform assembly 14 as can best be seen in FIGS. 1 and 2, comprises a base section 32 formed of a plurality of elongated slats 34 with adjacent slats being spaced apart by resilient members or pads 36, 38. The slats 34 can typically be made of wood with the resilient pads 36, 38 being made of rubber, plastic or similar resilient material. The resilient pads, 36, 38 can be of rectangular shape positioned in two spaced apart rows, with one row of the pads 36 being adjacent one side of the base section 32, and the other row of the pads 38 being positioned adjacent the other side of the base section 32. The portions transversely between each pair of spacers or pads 36, 38 are left empty to provide a space between adjacent slats 34.

The spacers 36, 38 can be glued or cemented between adjacent slats. The slats 34 are configured so that their upper surfaces 40 lie in a common upper plane, and their lower surfaces 42 lie in a lower common plane. The corner edges of the base section 32 are champhered at 44.

Axial holes or keyways 46, 48 are respectively formed through both the entire stack of adjacent slats 34 and the interspersed spacers 36, 38. Keyway 46 passes through the spacers 36, while the keyway 48 is positioned to pass through the spacers 38.

Rods 50, 52 pass through the respective keyways 46, 48 and are held at opposing ends by means of the clamping washers 54, which are crimped onto the ends of the rods 50, 52. The rods 50, 52 serve to retain and hold the stack of elongated slats and spacers together. Preferably, the rods 50, 52 are resilient, being fabricated from rubber, plastic and like material.

Beneath the base section 32 are base pads 56, 58 formed of resilient material, such as rubber or plastic. The base pads 56, 58 are elongated with their elongated axis lying parallel to the elongated axis of the slats 34. The base pads 56, 58 have a width spanning a number of slats 34. The length of the base pads 56, 58 is slightly shorter than the elongated length of the slats 34.

The base pads 56, 58 are secured directly onto the slats 34 of the base section 32, using suitable glue, cement and the like. The base pads 56, 58 are spaced apart on the base section 32 leaving the mid section of the base section 32 exposed. As shown in FIG. 4, the corners of the base pads 56, 58 may overlie the edges of the oval shaped toroidal member 16. However, the center spacing between the base pads is free. Accordingly, the wrapped toroidal member 16 is secured directly onto the base pads 56, 58, using suitable glue, cement and the like, whereby the portions of the toroidal member 16 between the base pads 56, 58 are free. The base section 32 formed with the elongated slats 34 is thus positioned over the base pads 56, 58 to overhang the base pads 56, 58 as well as overhang the oval shaped toroidal member 16, as can best be seen in FIG. 4.

Placed over the base section 32 is an elongated strip 60 having its elongated axis perpendicular to the elongated axis of the individual slats 34. Accordingly, the strip 60 is placed transversely across each of the slats 34 and is of a length substantially equal to the length of the base section 32. The width of the strip 60 is approximately equal to or slightly less than the transverse spacing between the resilient spacers 36, 38. The strip 60 is typically made of a pliant material, such as canvas.

Positioned on top of the strip 60, are two treads 62, 64. Each of the treads is formed of a multilayer construction with each of the lower layers 66, 68 respectively being of a firm material such as a wooden pad. A soft cushion material is placed respectively on top of the wooden pads, such as the layers 70, 72 formed of rubber or plastic material. The treads 62, 64 are elongated with their elongated axis being parallel to the elongated axis of the slats 34. The width of each tread 62, 64 spans a number of slats and approximately equals the corresponding width of the pads 56, 68 positioned therebeneath. The length of the treads 62, 64 is less than the length of each of the slats, being approximately equal to the length of the pads 56, 58 therebeneath.

Figure 8:
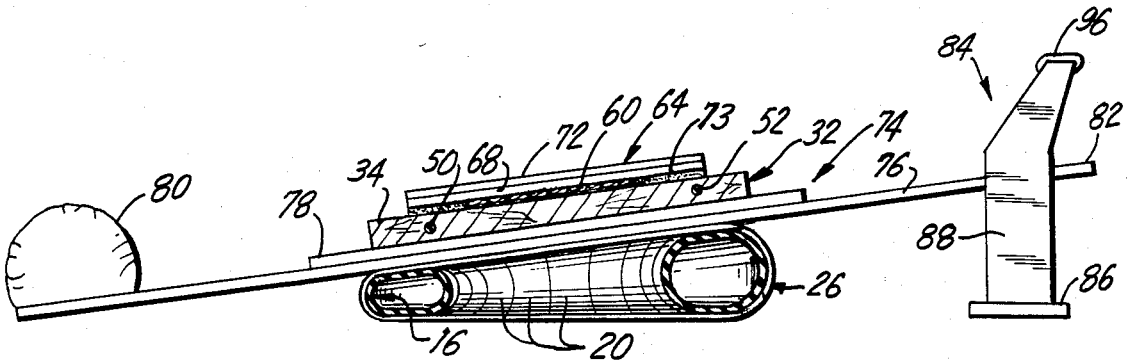
FIG. 8 is a side elevational view, partly in section, showing the utilization of the exercising board and the exercising stand, both in conjunction with the exercising device of FIG. 1.

When assembled, glue or other adhesive material can be used to hold the various sections together. Specifically, the layers forming the treads 62, 64 can be secured together by means of adhesive. The treads themselves are secured onto the slats 34 and the strip 60, as well securing the strip 60 onto the slats 34, by means of a suitable adhesive 73 so that the treads 62, 64 are parallel to the slats 34, as shown in FIG. 8. As stated above, the base section 32 is adhesively secured to the base pads 56, 58 which in turn are adhesively secured to the toroidal resilient member 16.

With the parts assembled, an individual user can walk, jump, or run in place with the user's feet positioned on top of the treads. When exerting the user's weight on one foot, the tread under that foot will press down onto the base section 32. Although the base section 32 is substantially rigid, because of the slat construction and the resiliency provided by the spacers 36, 38 between the slats 34, portions of the base section 34 beneath the tread receiving the weight of the user will slightly flex with respect to the remaining portions of the base section which do not have any weight thereon. The strip 60 will serve to smooth or spread out the load from the particular slats receiving the weight onto the next few slats to thereby distribute the load.

By means of the device heretofore described, the individual user can exercise by jogging or jumping in place. The specific pounding normally associated with jogging or jumping will not produce the normal loud noises because of the flexibility of the toroidal member or tube on the bottom of the exercising device. Therefore, there will be little or no disturbance to other people in the area.

At the same time, because of the presence of the flexible toroidal member 16, the jogger will not pound down on a very hard surface, but will jump onto a resilient surface which will absorb some of the jumping impact force. This makes the jogging or jumping easier than on a hard surface. However, even though the toroidal member 16 is flexible in order to absorb some of the initial impact of the jumping or jogging, at the same time the platform assembly will provide a sufficiently rigid surface to support the jogger so that the user will not fall off or lose his balance when jogging on the device.

Because the toroidal member 16 does flex, additional muscle structure of the user is utilized when jogging, since the surface beneath each foot of the user will give and will thereby simulate an outdoor terrain which is somewhat uneven and not completely uniformly flat. This will supply the benefit of additional muscular exertion on the part of the jogger.

Figure 5:
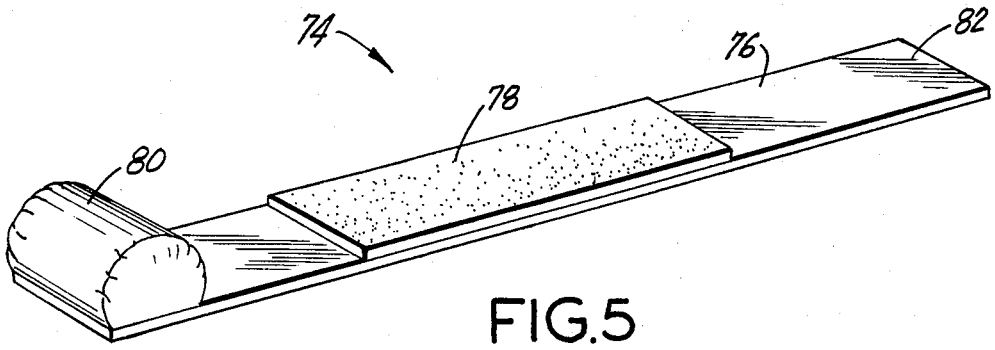
FIG. 5 is a perspective view of an exercising board which can be utilized independently or in conjunction with the exercising device of FIG. 1.

In addition to the particular exercises which can be achieved directly on the jogging device 10 shown in FIGS. 1–4, by utilizing additional external equipment in association with the jogging device 10 of FIGS. 1–4, numerous other exercises can also be achieved. Specifically, referring now to FIG. 5, there is shown an exercising board 74 formed of an elongated rigid board member 76 having a cushion or pad 78 provided along a substantial portion of its midsection. The pad 78 is secured on the board member by glue, cement or like adhesive means in a conventional manner.

At one end of the board 74, there is provided a pillow 80 fabricated from a resilient or cushion type material. The opposite end 82 of the board 74 is free of any material. The board itself can be utilized for various exercises, such as for example, situps, legups, etc. In doing these exercises, it would be helpful if the user would have the ability of having his feet held during the situps. Also, it would be beneficial to have the ability of elevating the foot end 82 of the exercising board 74.

Figure 6:
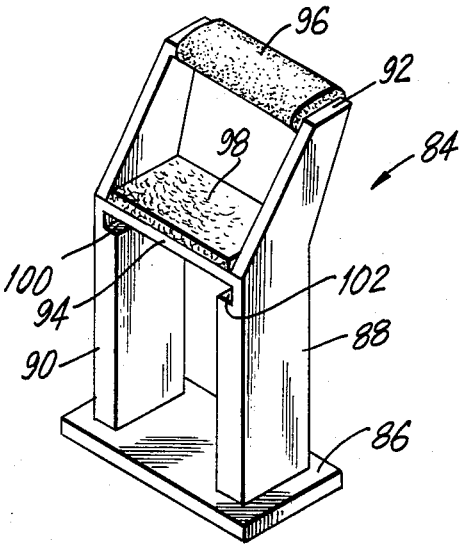
FIG. 6 is a perspective view of an exercising stand which can be used independently or in conjunction with the exercising board of FIG. 5 and the exercising device of FIG. 1.
Figure 7:
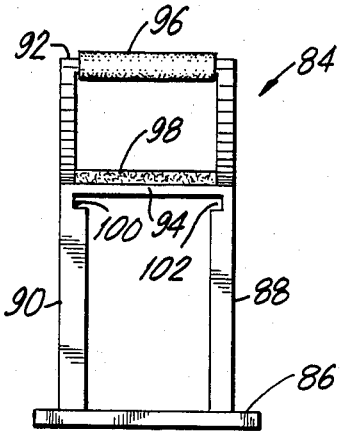
FIG. 7 is a front elevational view of the exercising stand shown in FIG. 6.

To achieve these capabilities, there is also provided an additional exercising device, shown as an exercising stand 84 in FIGS. 6 and 7. It should be appreciated, that FIGS. 6 and 7 show an enlarged view of the exercising stand 84 as compared with the view taken of the exercising board 74 in FIG. 5. The relative sizes is better appreciated in FIG. 8, as will hereinafter be explained.

The exercising stand 84 includes a base member 86 with two opposing upstanding sidewalls 88, 90 mounted thereon. The sidewalls 88, 90 terminate in a top wall 92 spanning the sidewalls 88, 90. Positioned beneath the top wall 92 and extending between the sidewalls 88, 90, there is a transverse shelf 94. Both the top wall 92 and the shelf 94 are covered with a cushion material, such as rubber or carpeting 96, 98, respectively.

The upper portions of the respective sidewalls 88, 90, extending from the shelf 94 to the top wall 92, are rearwardly directed and upwardly tapered, as shown best in FIG. 8. In this manner, the top wall 92 is rearward of the shelf 94 so as to expose the shelf 94 and facilitate the placing of feet of the user onto the shelf 94 without interference from the top wall 92. At the same time, the top wall 92 can be held from the rear by an exerciser without interference from the shelf 94.

Directly beneath the shelf 94 are an opposing pair of channels 100, 102 facing each other, and extending into and across the entire width of the walls 88, 90. The two channels 100, 102 define a receiving slot for receiving the foot end 82 of the exercising board 74.

The exercising board 74 in conjunction with the exercising stand 84, as well as the exercising device 10 shown in FIG. 1, can all be combined for use as a single exercising unit, as shown in FIG. 8. More specifically, the exercising board 74 can be secured onto the exercising device 10 of FIG. 1 by sliding it beneath the base section 32. Specifically, it can be placed in the space between the adjacent base pads 56, 58 so that it is positioned directly on the wrapped toroidal member 16 and beneath the slats 34, with the slats 34 resting on the cushion 78. The exercising board 74 is placed with its midsection positioned and balanced over the toroidal member 16 and the band 26. If desired, the band 26 can be repositioned 90 degrees into alignment with the strip 60 so that the band 26 would overlie the cushion 78 and board 74 for a better securement against the toroidal member 16. The foot end 82 of the board 74 is then slid through the opposing channels 100, 102 of the exercising stand 84 so that it is elevated. The pillow 80, positioned at the other end of the board 74, rests on the floor.

Using the arrangement shown in FIG. 8, an individual can lie down onto the base section 32 and place the heels of his feet on the shelf cushion 98 of the exercising stand 84 and have his toe portions retained behind the cushion 96 of the top wall 92. His head can then be placed on the pillow 80, and he can then do various types of situp exercises. Additionally, other types of exercises could be done with this arrangement, including feet lifts, knee bends from a lying position, etc.

It should be appreciated, that by utilizing the toroidal member 16 beneath the exercising board 74, the board 74 will not be as hard, and there will be some flexure in the toroidal member 16 as the individual continuously does his exercises. This flexure relieves some of the rigidity beneath the individual doing the exercises, thereby making it more convenient and less painful, while at the same time not losing any of the muscular benefits derived from the exercises.

Although the exercising board 74 and stand 84 were shown for use in conjunction with the exercising device 10 of FIGS. 1–4, it should be appreciated that the exercising stand 84 or board 74 can also be used independently. However, because of their ability to be combined, cost and space is reduced.

Although the oval shape of the toroidal member 16 was shown elongated in one direction, it should be appreciated that the base section 32 could be elongated in the opposite direction making it longer in the direction of the slats 34. Accordingly, the oval shape of the toroidal member 16 would be placed in the opposing direction, as indicated above with respect to the repositioning of the band 26.

There has been described heretofore the best embodiment of the invention presently contemplated. However, it is to be understood that various changes and modifications may be made thereto without departing from the spirit of the present invention.

What is claimed is:

1. An exercising device comprising:

an inflatable flexible toroidal member;

a substantially rigid platform disposed over and supported by said toroidal member;

at least one foot tread positioned on an upper surface of said platform;

said platform including flexing means for permitting flexing of one section of said platform relative to another section thereof, said platform including a plurality of elongated rigid slats having upper and lower surfaces;

said flexing means including resilient spacers secured between adjacent slats; and said upper and lower surfaces of said slats respectively lying in parallel planes, said upper surfaces of said slats defining said upper surface of said platform.

2. An exercising device as in claim 1, and comprising at least one keyway passing through said slats and spacers, and a corresponding rod extending through said keyway to tie said slats and spacers together.

3. An exercising device as in claim 1, wherein said foot tread includes a pair of elongated strips having their elongated axis lying parallel to elongated axis of said slats, each of said strips spanning at least a few slats.

4. An exercising device as in claim 3, wherein said strips are spaced apart.

5. An exercising device as in claim 3, and further comprising an elongated pliant panel having its elongated axis perpendicular to said elongated axis of said slats, said pliant panel being sandwiched between said strips and said upper surfaces of said slats for distributing a load placed on each strip.

6. An exercising device as in claim 3, wherein said elongated strips include a lower layer of rigid material and an upper layer of resilient material.

7. An exercising device as in claim 3, and comprising spaced apart elongated pads disposed on said lower surfaces of said slats, said pads having their elongated axis parallel to said elongated axis of said slats, each pad spanning a number of slats, said pads being sandwiched between said toroidal member and said lower surfaces of said slats.

8. An exercising device as in claim 7, wherein said elongated pads spacially underlie said strips.

9. An exercising device as in claim 7, wherein said strips are adhesively secured to said platform, said platform being adhesively secured to said pads, and said pads being adhesively secured to said toroidal member.

10. An exercising device as in claim 1, and comprising a wrapping strip wound about exterior walls of said toroidal member for preventing bulges from occurring in said toroidal member.

11. An exercising device as in claim 1, and comprising a peripheral band member diametrically binding said toroidal member to reshape it into an oval configuration.

12. An exercising device as in claim 1, and further comprising an elongated exercising board having its midsection balancing across said toroidal member in a space between said platform and said toroidal member.

13. An exercising device as in claim 12, wherein said exercising board includes a pillow member at one end.

14. An exercising device as in claim 12, wherein said exercising board includes a cushion pad provided on its midsection, said cushion pad being disposed against said platform.

15. An exercising device as in claim 12, and comprising spaced apart elongated pads sandwiched between said toroidal member and said platform, and wherein said exercising board balances across said toroidal member in the space which is provided between said pads.

16. An exercising device as in claim 12, and further comprising a stand having a receiving slot for receiving a foot end of said board and elevating said foot end of said board.

17. An exercising device as in claim 16, wherein said stand includes a base and a pair of spaced apart upstanding side walls supported on said base, a pair of opposing elongated channels provided respectively into each side wall to define said receiving slot.

18. An exercising device as in claim 17, wherein a top wall intersects said side walls, a shelf wall interconnecting said side walls and spaced beneath said top wall, said channels being disposed beneath said shelf wall.

19. An exercising device as in claim 18, wherein rearwardly directed wall portions of said side walls are disposed between said shelf wall and said top wall to provide ready access to said shelf wall without interference from said top wall.

20. An exercising device as in claim 19, wherein said rearwardly directed wall portions are upwardly tapered so that said top wall is narrower than said shelf wall.

21. An exercising device as in claim 18, comprising a cushion pad provided on both said shelf wall and said top wall.

* * * * *